United States Patent [19]

Resibois

[11] 4,281,488

[45] Aug. 4, 1981

[54] MULTIPANE WINDOW WITH ADJUSTABLE LIGHT ADMISSION

[75] Inventor: Raymond Resibois, Virton, Belgium

[73] Assignee: Para-Press S.A., Luxembourg

[21] Appl. No.: 119,425

[22] Filed: Feb. 7, 1980

Related U.S. Application Data

[63] Continuation of Ser. No. 760,022, Jan. 17, 1977, abandoned.

[30] Foreign Application Priority Data

Jan. 20, 1976 [LU] Luxembourg ..... 74212

[51] Int. Cl.[3] ..... E06B 3/66

[52] U.S. Cl. ..... 52/173 R; 52/790; 65/43; 160/107

[58] Field of Search ..... 52/171–173, 52/790; 160/107–111; 65/43, 40, 36, 23

[56] References Cited

U.S. PATENT DOCUMENTS

| | | | |
|---|---|---|---|
| 1,124,778 | 1/1915 | Meuler | 52/790 X |
| 2,854,102 | 9/1958 | Peeples | 160/107 X |
| 2,977,722 | 4/1961 | Mazzoni | 52/790 X |
| 3,153,819 | 10/1964 | Bond | 160/107 |
| 3,211,264 | 10/1965 | Streeter | 160/107 |
| 3,222,153 | 12/1965 | Browne | 65/43 |
| 3,253,644 | 5/1966 | Gotoh | 160/107 |

FOREIGN PATENT DOCUMENTS

| | | | |
|---|---|---|---|
| 1225830 | 9/1966 | Fed. Rep. of Germany | 160/108 |
| 2027717 | 12/1971 | Fed. Rep. of Germany | 160/107 |
| 498022 | 9/1954 | Italy | 160/107 |

*Primary Examiner*—J. Karl Bell
*Attorney, Agent, or Firm*—McGlew and Tuttle

[57] ABSTRACT

A window pane construction comprises first and second light-transmissive panel members having peripheries which are sealed together and defining a viewing pane portion between the peripheries of the panes. The panes are spaced apart to define a hollow air space therebetween and, for this purpose, one pane member is advantageously made trough-shaped and the bottom of the trough defines a viewing pane portion of this pane. A shade member is positioned in the hollow space and it may comprise, for example, a windup window shade type or a venetian blind type. The shade member is connected to actuating means which is mounted outside the two light-transmissive panes and connected to the shade member for adjusting the position of at least a portion of the member in order to vary the light penetration through the two panes.

4 Claims, 2 Drawing Figures

MULTIPANE WINDOW WITH ADJUSTABLE LIGHT ADMISSION

This is a continuation of application Ser. No. 760,022 filed Jan. 17, 1977 now abandoned.

FIELD AND BACKGROUND OF THE INVENTION

This invention relates in general to the construction of windows and, in particular, to a new and useful window pane construction which includes two light-transmissive pane members which are sealed together around their peripheries and constructed to define an air space therebetween which accommodates a shade member which is adjustable by actuating mechanism from the outside of the pane members.

DESCRIPTION OF THE PRIOR ART

The present invention relates to a multipane window with adjustable light admission, particularly for vehicles. Multipane windows, for example, with panes of acrylic or silicate glass and intended for house trailers are known per se, and may comprise a plurality of panes, for example two, which are joined to each other on their perimeters. Both panes may either have the shape of a tray, or one may be flat and the other tray-shaped.

In house trailers, such double-pane windows are usually provided at the inside, with a slide or roller window shade, in order to control the incident light as desired and to prevent looking into the interior of the trailer. However, in vehicles, for example, trailers, trucks, passenger cars, buses, railroad coaches, etc., where space saving is badly needed, such shades mounted at the inside of the windows are always disturbing and take up too much room. In addition, the projecting parts necessary for securing and actuating the shades do not comply with the present day vehicle security measures.

SUMMARY OF THE INVENTION

The present invention is directed to a multipane window which requires a minimum space and has no projecting parts.

In accordance with the invention, a blind for controlling the light admission is provided in the hollow space between the panes, which is connected to an actuating mechanism located outside the panes. Preferably, the space between the individual panes is evacuated and the connection between the blind and the actuating mechanism is made airtight.

The marginal strips of the window are preferably translucent, but not transparent, in order to permit the admission of light but to prevent looking through the margins laterally of the closed blind.

Accordingly, it is an object of the invention to provide a window pane construction which comprises two light-transmissive pane members which are connected together around their peripheries and which are shaped so as to define a hollow space which accommodates a shade member and which includes actuating means located outside the pane members which are connected to the actuating member to adjust the position of at least a portion of the shade member in order to vary the light penetration or viewing area through the panes.

A further object of the invention is to provide a window pane construction which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there are illustrated preferred embodiments of the invention.

DESCRIPTION OF THE PREFERRED EMBODIMENTS

Figure 1:
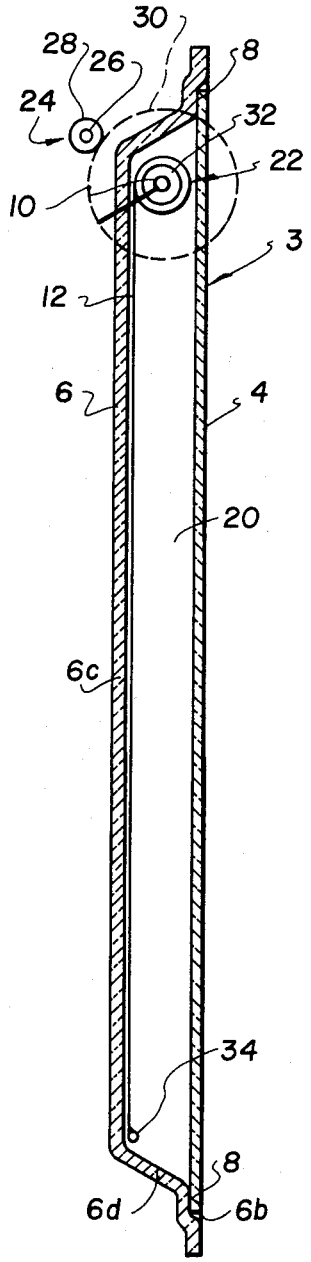
FIG. 1 is a sectional view of a window pane constructed in accordance with the invention.

Referring to the drawings in particular, the invention embodied therein in FIG. 1, comprises a window pane construction, generally designated 3, which comprises two pane members 4 and 6 which are constructed so as to define a hollow air space 20 therebetween. Pane members 4 and 6 are advantageously sealed around their peripheries at the location 8 so that the hollow space 20 defines a dead air insulation space. In the embodiment shown in FIG. 1, the pane member 6 is made of trough-shape configuration and it has a flange **6*a* with a recessed portion 6*b* which accommodates a marginal edge portion around the periphery of the pane member 4. The pane members 4 and 6** may be of ordinary silicate glass or acrylic glass or similar light-transmissive material. The materials of the panes are joined together and sealed in a well-known manner, such as, by cementing or fusing.

In accordance with the invention, a shade member, generally designated 22, is located in the hollow space 20 and, in the embodiment of FIG. 1, this comprises a roll-up type shade which is rollable on a cylinder 10 and which includes a flexible or bendable shade portion 12 which may be wound off the cylinder 10 and lowered to the lowermost end of a bottom portion **6*c* of the pane member 6**.

In accordance with a further feature of the invention, actuating means, generally designated 24, for actuating the shade member 22 includes a drive motor shaft 26 having a drive pinion 28 which drives a gear 30 affixed to a shaft 32 of the windup cylinder 10 to either wind or unwind the shade member 12 from the cylinder. Actuating means 24 is mounted on the outside of the two pane members 4 and 6 and it may comprise any means to rotate the shaft 32 containing the cylinder 10 for the purposes of raising or lowering the shade member 12.

In order to facilitate the downward movement of the shade member 12 off the cylinder 10, the lower portion is advantageously provided with a weight 34. It should be appreciated that shade member 12 could also be rolled off along pane 4 and that it may even be lowered beyond troughshaped oblique edges **6*d* of the pane member 6, if desired. The end containing the insert 34** may also be attached to the actuating mechanism, for example, by an endless chain, in order to effect the winding and unwinding completely automatically.

Figure 2:
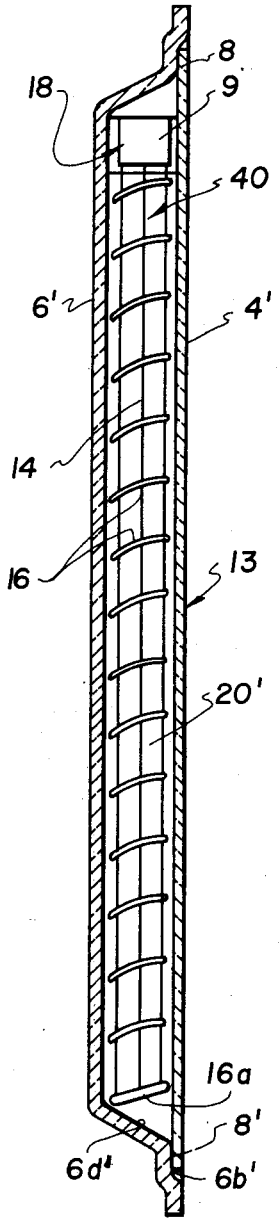
FIG. 2 is a view similar to FIG. 1 of another embodiment of the invention.

In the embodiment shown in FIG. 2, there is provided a window pane construction 13 which is made up of panels 6' and 4' which are shaped similar to the other embodiment and are sealed at 8 around their peripheries and define a hollow space 20' therebetween. In this construction, a shade member, generally designated 40, is disposed in the hollow space 20' and it comprises a venetian blind-type which include individual slots 16 which may be pivoted about their horizontal longitudinal axes in a well-known manner by means of a suitable actuating mechanism, generally designated 18, which may be hand- or machine-operated from the exterior of the panels. The actuating mechanism 18 may be designed for pivoting the individual slots in one or both directions, or also for lifting them up completely or partly in order to vary the viewing area defined within the peripheries of the two pane members 4' and 6' which are sealed. Shade member 40 may therefore completely close off or partially close off any portion of the viewing pane defined within the peripheries of the two panels. In the construction of FIG. 2, a lowermost slot 16*a* may be made of a heavier material in order to weight this end and permit the lowering of the blind in an easier manner or the operating mechanism 18 may be such to drive the blind upwardly and downwardly as desired. Instead of vertically movable slats 16, pivotable about a horizontal axis, it is also possible to provide vertically disposed slats which are pivotable about vertical axes and which may be shifted laterally from one side of the viewing pane area to the other, for example.

The marginal strips 6',6*b'* and 6*d'* which are not covered by a shade member are advantageously made translucent but not transparent in order to prevent looking through the pane when the blind is closed. For this purpose, the oblique surfaces 6*d'* as well as the flanges 6' may be made non-transparent as well as a marginal strip area of the pane 4'. Such non-transparent marginal areas may be made light-transmissive in a known manner, for example, by ribbing, surface-shaping, painting, adhesive tapes, etc.

The inventive window may be made in many other embodiments than those shown in FIGS. 1 and 2, and in a construction in which the panes are sealed together and define a hollow space therebetween having any type of shade member which may be moved from the exterior to open or close a portion of the light-transmissive or viewing area thereof. The inventive window provides a window construction which may occupy only a small space and the shade members will have a long life since they do not come into contact with foreign objects. In addition, the hermetic closure of the window prevents dust penetration so that the blinds remain clean and no maintenance is required.

While specific embodiments of the invention have been shown and described in detail to illustrate the application of the principles of the invention, it will be understood that the invention may be embodied otherwise without departing from such principles.

What is claimed is:

1. A window and shade combination comprising, a first transparent member having a planar portion, a peripheral side wall portion extending at an angle to said planar portion and around the periphery thereof defining a trough shaped space with said planar portion, and a peripheral flange portion extending from said peripheral side wall portion around the periphery thereof and substantially parallel to said planar portion, said peripheral flange portion having a peripheral recess, said planar portion, said peripheral side wall portion and said peripheral flange portion all being transparent, a planar second transparent member peripherally connected to said peripheral flange portion of said first transparent member and disposed within said peripheral recess to close said trough shaped space, and a shade member connected in said trough shaped space and movable therein, said first transparent member made of a single sheet of transparent material, said peripheral flange portion having a thickness of said sheet of transparent material whereby said combination can be installed into windows adapted to receive a single thickness of transparent material.

2. A combination according to claim 1, wherein said first and second transparent members comprise acrylic glass which are adhesively secured to each other at said peripheral recess.

3. A combination according to claim 1 wherein said peripheral flange portion has an outer planar part extending outwardly beyond said peripheral recess forming a frame engagement part, said frame engagement part being co-planar with said planar second transparent member and having one surface on the side thereof opposite from said side wall portion extending parallel and in the plane of a surface of said planar second transparent member on a side thereof opposite from said side wall portion.

4. A combination according to claim 3 including a drive member extending through said peripheral side wall portion and connected to said shade member for moving said shade member within said trough shaped space.

* * * * *